US009372019B2

(12) United States Patent
Allan et al.

(10) Patent No.: US 9,372,019 B2
(45) Date of Patent: Jun. 21, 2016

(54) DUAL CIRCUIT REFRIGERANT CONDENSER

(71) Applicant: MAHLE International GmbH, Stuttgart (DE)

(72) Inventors: Lisa A. Allan, Lockport, NY (US); Nicholas J. Alonge, Jr., East Amherst, NY (US); Mark R. Hammer, Getzville, NY (US); Timothy J. Filonczuk, Williamsville, NY (US); William D. Wright, Newfane, NY (US); Judd W. Glenn, Cornelius, NC (US); Shrikant M Joshi, Williamsville, NY (US); Joel T. Hambruch, Newfane, NY (US); Rogelio Salais, Juarez (MX)

(73) Assignee: MAHLE International GmbH, Stuttgart (DE)

( * ) Notice: Subject to any disclaimer, the term of this patent is extended or adjusted under 35 U.S.C. 154(b) by 57 days.

(21) Appl. No.: 14/277,234

(22) Filed: May 14, 2014

(65) Prior Publication Data

US 2015/0330683 A1 Nov. 19, 2015

(51) Int. Cl.
*F25B 39/04* (2006.01)

(52) U.S. Cl.
CPC ..... *F25B 39/04* (2013.01); *F25B 2500/18* (2013.01)

(58) Field of Classification Search
CPC ..... F25B 39/04; F25B 39/00; F25B 40/00; F25B 43/00; F25B 2339/00
USPC ..... 62/498, 509; 165/173, 132, 143
See application file for complete search history.

(56) References Cited

U.S. PATENT DOCUMENTS

| | | | | | |
|---|---|---|---|---|---|
| 5,875,650 | A * | 3/1999 | Nobuta | B60H 1/3227 | 165/110 |
| 6,397,627 | B1 * | 6/2002 | Aki | F25B 39/04 | 62/509 |
| 7,093,461 | B2 * | 8/2006 | Patel | F25B 39/04 | 62/509 |
| 7,096,930 | B2 * | 8/2006 | Nobuta | F25B 39/04 | 165/132 |
| 2005/0039893 | A1 * | 2/2005 | Nobuta | F25B 39/04 | 165/132 |
| 2005/0204772 | A1 * | 9/2005 | Patel | F25B 39/04 | 62/509 |
| 2005/0268645 | A1 * | 12/2005 | Kent | F25B 39/04 | 62/509 |
| 2006/0060327 | A1 * | 3/2006 | Yu | F16H 57/04 | 165/70 |
| 2008/0115528 | A1 * | 5/2008 | Yamamoto | B60H 1/3227 | 62/513 |
| 2012/0227946 | A1 * | 9/2012 | Kent | F25B 39/04 | 165/173 |

* cited by examiner

*Primary Examiner* — Mohammad M Ali
(74) *Attorney, Agent, or Firm* — Brinks Gilson & Lione

(57) ABSTRACT

A dual circuit condenser for a cooling system is configured to cool refrigerant passing through the condenser. Operation of a first circuit of the system establishes a first temperature at a first area of the condenser, and operation of a second circuit of the system establishes a second temperature at a second area of the condenser. The condenser includes a manifold. The manifold is configured to receive a plurality of tubes. The manifold is further configured to define a first volume that is part of the first circuit and a second volume that is part of the second circuit. The manifold includes three or more separators interposed between the first volume and the second volume to segregate refrigerant in the first circuit from refrigerant in the second circuit.

8 Claims, 2 Drawing Sheets

DUAL CIRCUIT REFRIGERANT CONDENSER

TECHNICAL FIELD OF INVENTION

This disclosure generally relates to a dual circuit refrigerant condenser, and more particularly relates to a manifold with separators to segregate refrigerant in a first volume of the manifold from refrigerant in a second volume of the manifold.

BACKGROUND OF INVENTION

A dual circuit refrigerant condenser may be preferable to reduce system cost when, for example, a single fan can be used to urge air through the condenser. One proposed configuration of a dual circuit condenser uses a shared manifold that has a separator within the manifold to establish to isolated volumes within the manifold and thereby maintain distinct circuits. However, it has been discovered that some separator configurations undesirable increase stress on refrigerant conveying tubes fluidicly coupled to the manifold when the temperature of refrigerant in one circuit is substantially different from the temperature of refrigerant in the other circuit.

SUMMARY OF THE INVENTION

In accordance with one embodiment, a dual circuit condenser for a cooling system is provided. The condenser is configured to cool refrigerant passing through the condenser. Operation of a first circuit of the system establishes a first temperature at a first area of the condenser, and operation of a second circuit of the system establishes a second temperature at a second area of the condenser. The condenser includes a manifold. The manifold is configured to receive a plurality of tubes. The manifold is further configured to define a first volume that is part of the first circuit and a second volume that is part of the second circuit. The manifold includes three or more separators interposed between the first volume and the second volume to segregate refrigerant in the first circuit from refrigerant in the second circuit.

In another embodiment, a manifold for a dual circuit condenser is provided. The manifold is configured to define a first volume that is part of a first circuit and a second volume that is part of a second circuit. The manifold includes three or more separators interposed between the first volume and the second volume to segregate refrigerant in the first volume from refrigerant in the second volume.

In one embodiment of the condenser or the manifold, the manifold includes four separators that consist of a second separator and a third separator interposed between a first separator and a fourth separator. The second separator and the third separator cooperate to define a third volume interposed between and isolated from the first volume and the second volume.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
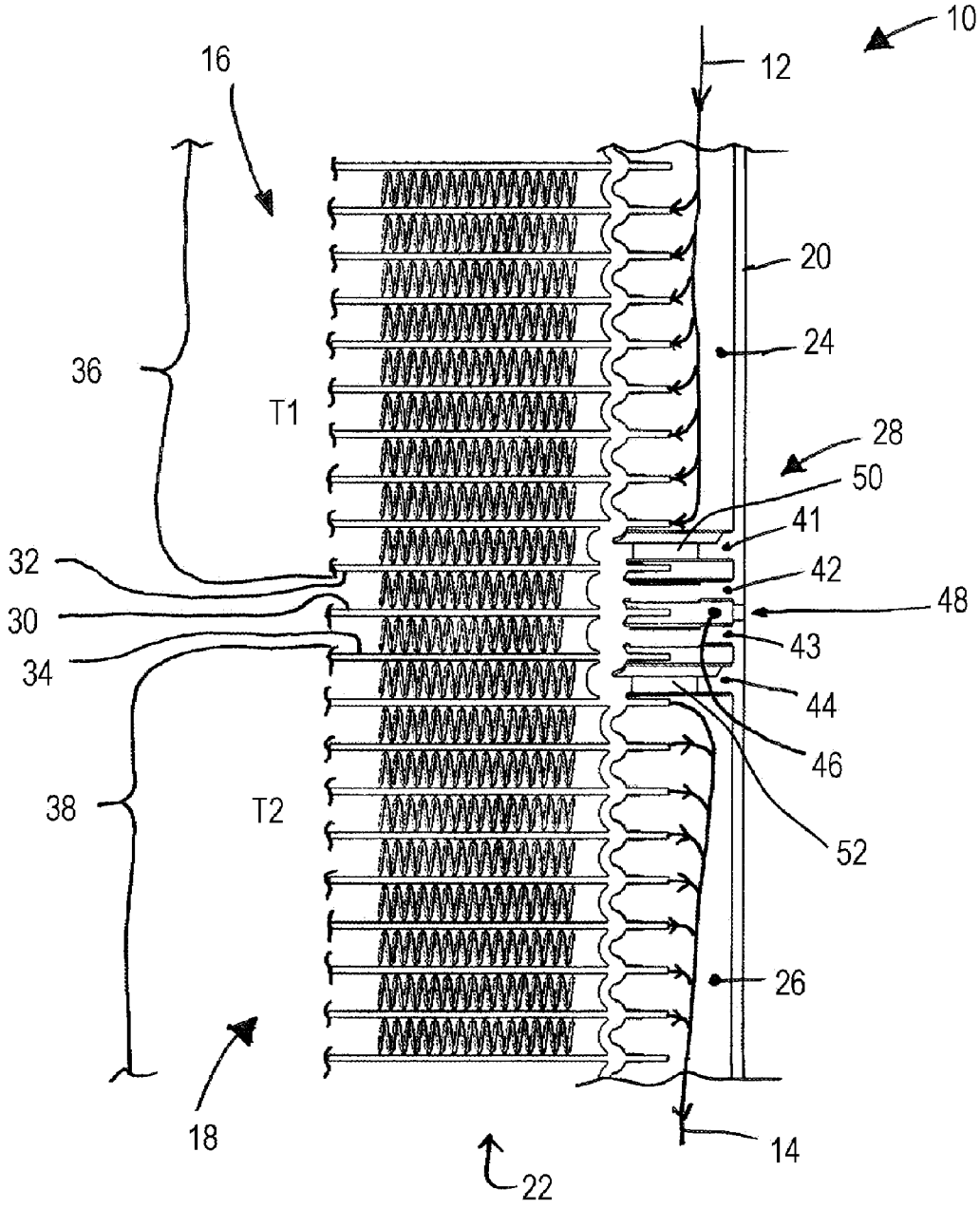
FIG. 1 is a cut-away view of a dual circuit condenser in accordance with one embodiment.

FIG. 1 illustrates a non-limiting example of a dual circuit condenser for a cooling system (not shown), hereafter referred to as the condenser 10. The system may be a building air conditioning system or refrigeration system, as will be recognized by those in the art. In general, the condenser 10 is configured to cool refrigerant such as R410A passing through the condenser 10. However, it is contemplated that the teachings presented herein are applicable to any heat exchanger that is configured for dual circuit operation, or is subject to the differential temperatures described in more detail below.

When the condenser 10 is being used in a dual circuit cooling system where refrigerant or coolant in a first circuit 12 is not mixed or comingled with refrigerant or coolant in a second circuit 14, the temperature of refrigerant in the first circuit 12 may differ from the temperature of refrigerant in the second circuit 14. That is, operation of the first circuit 12 of the system establishes a first temperature T1 at a first area 16 of the condenser 10, and operation of the second circuit 14 of the system establishes a second temperature T2 at a second area 18 of the condenser 10.

It should be understood that the illustration of the first circuit 12 and the second circuit 14 are meant to illustrate or suggest the flow of refrigerant into or out of the condenser 10. It is contemplated that the first circuit 12 and/or the second circuit 14 would also include features not illustrated such a pump or compressor to urge the refrigerant to circulate, an evaporator or other heat exchanger to make use of the refrigerant cooled by the condenser 10, one or more fans to urge air through the condenser 10 or other heat exchanging devices in the system, and other devices common to cooling or heating systems known to those in the art.

Continuing to refer to FIG. 1, the condenser 10 includes a manifold 20 configured to receive a plurality of tubes (hereafter—the tubes 22) for conveying refrigerant to and from the manifold 20. In general, the tubes 22 are for providing a large surface area so heat can be readily exchanged with air flowing across the tubes, typically in a direction normal to the sheet on which FIG. 1 is illustrated. The manifold is configured to define a first volume 24 that is part of (i.e. helps to define the path of) the first circuit 12 and a second volume 26 that is part of (i.e. helps to define the path of) the second circuit 14. To this end, the manifold 20 includes three or more separators 28 interposed between the first volume 24 and the second volume 26 to segregate refrigerant in the first circuit 12 from refrigerant in the second circuit 14.

For reasons that will become apparent, the following features are defined: a dead tube 30 that is characterized as not in fluid communication with the first circuit 12 or the second circuit 14, and defines the boundary between the first area 16 and the second area 18; a first upper tube 32 characterized as in fluid communication with the first circuit 12, and is the closest tube to the dead tube that is in the first area 16; and a first lower tube 34 characterized as in fluid communication with the second circuit 14 and, is the closest tube to the dead tube that is in the second area 18. Also, the tubes 22 in the first area 16 constitute a first group 36 of the tubes 22; and the tubes 22 in the second area 18 constitute a second group 38 of the tubes 22. It follows that the first group 36 is fluidicly coupled to the first volume 24, and a second group 38 is fluidicly coupled to the second volume 26.

Figure 2:
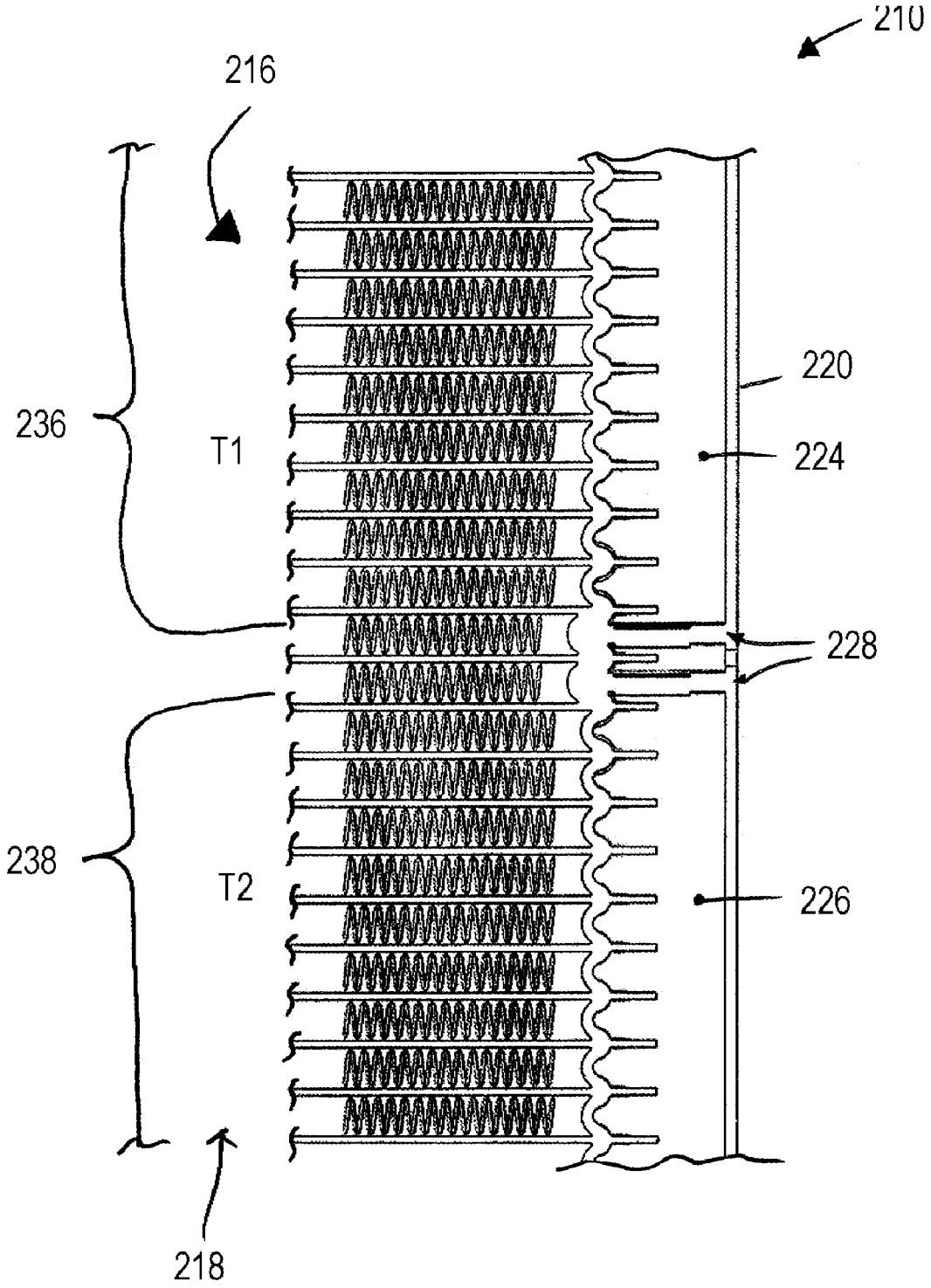
(PRIOR ART) Fig. 2
FIG. 2 is a cut-away view of a known dual circuit condenser in accordance with one embodiment.

FIG. 2 illustrates a known example of a condenser 210. The condenser 210 has two separators 228 interposed between a first volume 224 and a second volume 226. It has been observed that when the condenser 210 is installed in certain systems, the first upper tube 232 and/or the first lower tube 234 is overstressed. The overstress has been observed to cause fractures in the first upper tube 232 and/or the first lower tube 234 at the braze joint where the respective tubes are attached to the manifold 220. While not subscribing to any particular theory, it is thought that a large differential fluctuation of the first temperature T1 of the first area 216 with respect to the second temperature T2 of the second area 218 is a cause of overstress. Differential temperatures of T1−T2=161° C. have been observed in instances when one circuit was operating (e.g.—refrigerant was flowing in the first circuit 12) while the other circuit was not operating (e.g.—refrigerant was not flowing in the second circuit 14).

A finite element analysis that imposed a differential temperature on the condenser 210 where the first group 236 of tubes is 161° C. hotter than the second group 238 of tubes (i.e. T1−T2=161° C.) suggests that the difference in expansion of the first group 236 of relative to the second group 238 could overstress the first upper tube 232 and/or the first lower tube 234 at the braze joint where the respective tubes are attached to the manifold 220.

Referring again to FIG. 1, the condenser 10 is configured so the manifold 20 includes four separators (the separators 28) that consist of a second separator 42 and a third separator 43 interposed between a first separator 41 and a fourth separator 44, wherein the second separator 42 and the third separator 43 cooperate to define a third volume 46 interposed between and isolated from the first volume 24 and the second volume 26. As the separators 28 in this non-limiting example are spaced apart about the same distance as the tubes 22 are spaced apart, the first separator 41 includes an opening 50 to allow the first upper tube 32 to maintain fluidic communication with the first circuit 12, and the fourth separator 44 includes an opening 52 to allow the first lower tube 34 to maintain fluidic communication with the second circuit 14.

A finite element analysis that imposed a differential temperature on the condenser 10 where the first group 36 of tubes is 161° C. hotter than the second group 38 of tubes (i.e. T1−T2=161° C.) suggests the addition of the first separator 41 and the second separator 44 (relative to the configuration shown in FIG. 2) reduces the stress on the first upper tube 32 and/or the first lower tube 34 at the braze joint where the respective tubes are attached to the manifold 20 by 18.9% relative to the configuration of the condenser 210 shown in FIG. 2.

The first separator 41 may include an opening 50, so the first upper tube 36 is in fluidic communication with the first volume 24. Likewise, the separator 44 may include an opening 52 so the first lower tube 34 is in fluidic communication with the second volume 26.

The manifold 20 may include or define a vent hole 48 configured to vent the third volume 46 to atmosphere, that is to whatever is surrounding the exterior of the manifold 20. The vent hole 48 is advantageous because it provides greater assurance that refrigerant from one of the circuits (the first circuit 12 or the second circuit 14) is not communicated or transferred into the other circuit if a leak occurs at the second separator 42 or the third separator 43. That is, it is generally preferable to have the refrigerant charge of one circuit leak to atmosphere instead of leaking into the other circuit.

The condenser 10 may a dead tube 30 attached to the third volume 46. In this instance, describing the dead tube 30 as being attached to the third volume means that the dead tube 30 is not in fluidic communication with the third volume. Having the dead tube 30 fluidicly isolated from the third volume 46 may be advantageous for the same reasons given above regarding the greater assurance that refrigerant from one of the circuits (the first circuit 12 or the second circuit 14) is not communicated or transferred into the other circuit if a leak occurs.

Alternatively, the dead tube 30 may be fluidicly coupled to the third volume 46. One advantage of this configuration is that the dead tube 30 is not treated any differently from all of the other tubes. As such, the tubes 22 and the fins interposed between each of the tubes can be manufactured more easily as it will not matter which of the tubes 22 is the dead tube 30 when the manifold 20 is brazed to the tubes. In addition, it may be advantageous for the same reasons given above regarding the greater assurance that refrigerant from one of the circuits (the first circuit 12 or the second circuit 14) is not communicated or transferred into the other circuit if a leak occurs.

Accordingly, a condenser 10 for a cooling system is provided. The condenser descried herein is an improvement over the prior art as stress on some of the tubes 22 that make up the condenser 10 is reduced by adding separators 28 within the manifold 20.

While this invention has been described in terms of the preferred embodiments thereof, it is not intended to be so limited, but rather only to the extent set forth in the claims that follow.

We claim:

1. A dual circuit condenser for a cooling system, the condenser configured to cool refrigerant passing through the condenser, wherein operation of a first circuit of the system establishes a first temperature at a first area of the condenser, and operation of a second circuit of the system establishes a second temperature at a second area of the condenser, the condenser comprising:

a manifold connected to and in fluid communication with a plurality of tubes, the manifold containing a first volume that is part of the first circuit and a second volume that is part of the second circuit, wherein the manifold includes three or more separators interposed between the first volume and the second volume, at least two of the separators segregating refrigerant in the first circuit from refrigerant in the second circuit, wherein the three or more separators are all spaced apart from an adjacent separator by a distance about equal to a distance between adjacent tubes so that the manifold is connected to one tube between two adjacent tubes of the three or more separators.

2. The condenser in accordance with claim 1, wherein the manifold includes four separators that consist of a first, a second, a third, and a fourth separator, the second separator and the third separator interposed between the first separator and the fourth separator, wherein the second separator and the third separator cooperate to define a third volume interposed between and isolated from the first volume and the second volume.

3. The condenser in accordance with claim 2, wherein the manifold includes a vent hole fluidicly connecting the third volume to atmosphere.

4. The condenser in accordance with claim 2, wherein the plurality of tubes includes a first group fluidicly coupled to the first volume, a second group fluidicly coupled to the second volume, and a dead tube attached to the manifold proximate to the third volume.

5. The condenser in accordance with claim 4, wherein the dead tube is fluidicly coupled to the third volume.

6. The manifold in accordance with claim 2, wherein the first separator and the fourth separator each have at least one opening therethrough establishing a fluid path through the first separator and the fourth separator.

7. A manifold for a dual circuit condenser, the manifold containing a first volume that is part of a first circuit and a second volume that is part of a second circuit, the manifold comprising:

four separators interposed between the first volume and the second volume, at least two of the separators separating refrigerant in the first volume from refrigerant in the second volume, the four separators consisting of a first, a second, a third, and a fourth separator, the second separator and the third separator interposed between the first separator and the fourth separator, wherein the second separator and the third separator cooperate to define a third volume interposed between and isolated from the first volume and the second volume, the third volume being fluidicly isolated from both the first volume and the second volume, and wherein the first separator and the fourth separator each have at least one opening therethrough establishing a fluid path through the first separator and the fourth separator.

8. The manifold in accordance with claim 7, wherein the manifold defines a vent hole fluidicly connecting the third volume to atmosphere.

* * * * *